United States Patent [19]

Doolaege

[11] Patent Number: 5,059,065

[45] Date of Patent: Oct. 22, 1991

[54] APPARATUS AND A METHOD FOR JOINING WATER STRUCTURE SECTIONS OR THE LIKE

[76] Inventor: David Doolaege, P.O. Box 206, Carlotta, Calif. 95528

[21] Appl. No.: 646,170

[22] Filed: Jan. 25, 1991

[51] Int. Cl.[5] ..... E02B 7/00

[52] U.S. Cl. ..... 405/115; 405/21; 405/91; 405/107

[58] Field of Search ..... 405/15, 16, 21, 22, 405/28, 35, 115, 114, 91, 107, 108, 109, 233

[56] References Cited

U.S. PATENT DOCUMENTS

| | | | |
|---|---|---|---|
| 1,421,857 | 7/1922 | Store | 405/107 X |
| 3,373,568 | 3/1968 | Harnbostel | 405/21 |
| 3,396,545 | 8/1968 | Lamberton | 405/233 |
| 3,492,823 | 2/1970 | Lamberton | 405/233 |
| 3,643,440 | 2/1972 | Knisse et al. | 405/107 X |
| 4,555,201 | 11/1985 | Paoluccio | 405/21 |
| 4,650,368 | 3/1987 | Bayer | 405/107 X |
| 4,729,691 | 3/1988 | Sample | 405/21 |
| 4,799,821 | 1/1989 | Brodersen | 405/115 |
| 4,981,392 | 1/1991 | Taylor | 405/115 |

*Primary Examiner*—Dennis L. Taylor

*Attorney, Agent, or Firm*—M. Reid Russell

[57] ABSTRACT

A coupling sleeve arrangement and method for joining or interconnecting water structure sections into a dam or other water or liquid containing barrier where each water structure section consists of at least two closed water filled inner sleeves or bags that are contained within an outer sleeve. A coupling sleeve of the invention is for joining the water structure sections together and is an open outer sleeve that contains a water filled plug. The coupling sleeve, in one configuration and prior to water filling, receives ends of water structure sections that are fitted therein, abutting the connecting sleeve plug, which inner sleeves and plug are then filled with water through filler spouts that are then closed. Alternatively, to intersect one water structure section with another, prior to filling, a water structure section end is fitted into an end of the coupling sleeve abutting the plug, and a another empty water structure section is laid over the other coupling sleeve end and the respective inner sleeves and plugs are water filled and expand the inner sleeves and the plug, the end of the connecting sleeve plug fitting tightly against the side of the other water structure section.

17 Claims, 4 Drawing Sheets

APPARATUS AND A METHOD FOR JOINING WATER STRUCTURE SECTIONS OR THE LIKE

BACKGROUND OF THE INVENTION

1. Field of the Invention

This invention relates to water structures for damming water courses, the controlling of water flow and the like, and, in particular, provides a low cost and easily constructed sleeve arrangement for linking and connecting together sections of water structure tubular sections into dams, breakwaters, and for sectioning off water containing areas for de-watering.

2. Prior Art

There is clearly a need for easily installable dam structures, particularly structures that are relatively inexpensive, non-permanent, reuseable and are durable. Such are also particularly desirable for controlling pollution problems resulting from oil or chemical spills, for flood control, and the like. Such dam structures are also useful, for example, for temporary damming operations such as may be involved in farming operations for de-watering fields, for use as temporary breakwaters, and the like.

It has been recognized in the past that fluid filled flexible dams and barriers can be used for retention of water or control of water flow and wave action. A number of U.S. patents that show various configurations of dams and barriers that can generally be considered temporary structures have been issued serving these and like functions. Such arrangements are shown generally, for example, in certain U.S. Patents to: Mesnager, U.S. Pat. No. 2,609,666; Mesnheger, U.S. Pat. No. 3,246,474; Imbertson, et al, U.S. Pat. No. 3,355,851; Renfro, U.S. Pat. No. 3,465,530; Tabor, U.S. Pat. No. 3,834,167; Hornbostel, Jr., U.S. Pat. No. 3,373,568; Hepworth, et al, U.S. Pat. No. 3,957,098; Suga, et al, U.S. Pat. No. 4,279,540; Muramatsu, et al, U.S. Pat. No. 4,299,514; Tsuiji, et al, U.S. Pat. No. 4,314,774; Clem, U.S. Pat. No. 4,501,788; Paoluccio, U.S. Pat. No. 4,555,201; Holmberg, U.S. Pat. No. 4,690,585; Stevens, U.S. Pat. No. 4,784,520; and Brodersen, U.S. Pat. No. 4,799,821. The above show various dam and barrier configurations ranging from permanent to portable structures, including as shown in Stevens and Brodersen, a structure for encircling a chemical or oil spill. Additionally, a Swiss patent No. CH657,884 to Fure also shows a dam structure. A breakwater structure is shown in a U.S. Pat. No. 4,729,691, that includes a plurality of sand filled bags that are contained within an outer sleeve for serving as a barrier in an erosion control system.

Additional to the above cited art, the present inventor has applied for a U.S. patent in a "Method and Apparatus for Constructing Hydraulic Dams and the Like", filed Mar. 9, 1987, Ser. No. 07/023,693, that is still in prosecution, that teaches water structures for arrangement as dams and the like. The connecting sleeve of the present invention is intended for use with these water structures Neither the earlier invention of the present inventor nor the other cited patents that involve dam structures provide, as does the present invention, a connecting sleeve arrangement for joining water structure sections together end-to-end and in angled relationships to one another.

A number of the above cited patents involve inflatable envelopes as taught by the earlier application of the present inventor in a "Method and Apparatus for Construction of Hydraulic Dams and the Like", and some even provide anchor structures therewith. Such structures are suitable for a number of uses but they are restricted as they either require anchors or must be permanently installed Most require extensive site preparation and a number even require a concrete bottom and sidewalls in order to provide for support of the barrier, diminishing their use as temporary structures.

Distinct from the above cited art, both the dam structure of the earlier patent application of the present inventor and the connecting arrangement of the present invention for joining water structure sections together provide a low cost, easily constructed barrier that may be used with little or no site preparation that can function as a dam breakwater, water course, for use in field de-watering, and/or for many other purposes.

BRIEF SUMMARY OF THE INVENTION

It is therefore a principal object of the present invention to provide a system and its use for joining of water filled structure sections in end-to-end or intersecting relationships for forming dams, breakwaters, and the like.

Another object of the present invention is to provide a connecting sleeve and plug arrangement for joining water structure sections that will, when a potentially damaging hydraulic force is applied, tend to break at that juncture releasing the hydraulic force before damage to the water structure sections can occur.

Another object of the present invention is to provide a connecting sleeve that includes a water filled plug independent of the water structure sections.

Still another object of the present invention is to provide a connecting sleeve arrangement for joining water structure sections whose height can be set to below the level of the water structure sections for providing a spillway, or the like, to pass a water flow thereover.

Still another object of the present invention is to provide a connecting sleeve arrangement that is also useful for joining tubular water structure sections at an angle into another structure formed from other water structure sections.

Still another object of the present invention is t provide a connecting sleeve arrangement for joining water filled tubular water structure sections to one another, that is easy to both install and maintain, and can be installed with minimum to no site preparation.

The present invention is in connecting sleeve arrangements for joining tubular water structure sections into a dam, or like water containing structure. The tubular water structure sections are each at least a plurality of closed and water filled sleeves or bags contained within an outer bag or sleeve. The water filled bags once filed interacting to prohibit rolling or other displacing movement responsive to application of a hydraulic force thereagainst. So arranged, a dam made up of the water filled water structure sections is useful for providing a barrier to contain water.

The present invention is in a connecting sleeve arrangement for joining tubular water structure sections end-to-end into a dam, or to join them at intersecting angles to separate areas for de-watering, or the like. Each water structure section is an arrangement of a plurality of water filled sleeves that are closed at their ends and are themselves contained within an outer sleeve or envelope. The connecting sleeve of the present invention is for joining the water structure sections end-to-end or at angles into one another. Each connecting sleeve arrangement consists of an open sleeve with a water filled plug contained therein. The plug is either an arrangement of a single water filled close sleeve or bag or is plurality of closed water filled sleeves or bags that are contained in the open sleeve. The water weight of the plug and the abutting water structure sections holding the assembly in place. Which connecting open sleeve may be appropriately laterally center scored to provide for its breaking when a hydraulic force is applied thereto, as could be sufficient to damage the water structure sections The connecting sleeve plug can be filled with liquid to a level that is below the level of the adjacent water structure sections, presenting a lower profile. So arranged, the connecting sleeve arrangement will function as an overflow or spillway. Further, the connecting sleeve can be utilized to connect water structure sections at angles to one another, the one abutting and sealing against the other as for separating an area for de-watering.

The preferred connecting sleeve arrangement is an open sleeve that is formed from a material like that used to form the water structure sections. In practice a flexible polyethylene plastic tube manufactured by Armin Plastics, that has a range of wall thickness of four (4) to ten (10) millimeters has been used successfully for this application. The open sleeve may or may not be centrally laterally scored for providing breakaway and is preferably filled with one or more water filled closed sleeves or bags. The connecting sleeve arrangement of the present invention allows water structure sections to be joined together into longer sections than would be practical if only single water structure sections were used due to a potential for breakage or puncture of such single long structure. The connecting sleeve arrangement provides for ease of repair of an existing dam structure on a breach thereof, and allows for the construction of long dam or other water directing or containing structures.

The present invention is also directed to a method whereby a ground area is prepared to receive connected water structure sections that, prior to filling with water, are fitted through open ends of a connecting sleeve arrangement that contains a plug that will also be filled with water. The individual inner sleeves within the water structure sections are then filled, as is the connecting sleeve plug, the weight of the water in the water structure sections and plug resting on the bottom surface of which connecting sleeve anchoring it in place, with the water structure section ends abutting against the connecting sleeve plug, forming, essentially, a continuous section. Further, the method of the present invention involves a use of the connecting sleeve arrangement to join one end of a water structure section into the side of another water structure section. This arrangement involves fitting one end of the empty connecting sleeve containing a plug over an empty water structure section end and laying another empty water structure section across the other connecting sleeve arrangement end and then filling with water the respective water structure sections and the connecting sleeve plug. A number of such structures, spaced apart appropriately, each intersecting the first water structure section can be used for separating an area into segments for dewatering. The method of the present invention teaches the arranging of the water structure sections with connecting sleeves that are then water filled to erect an appropriate water containing structure.

DESCRIPTION OF THE DRAWINGS

In the drawings which illustrate that which is presently regarded as the best mode for carrying out the invention.

DETAILED DESCRIPTION OF THE INVENTION

Figure 1:
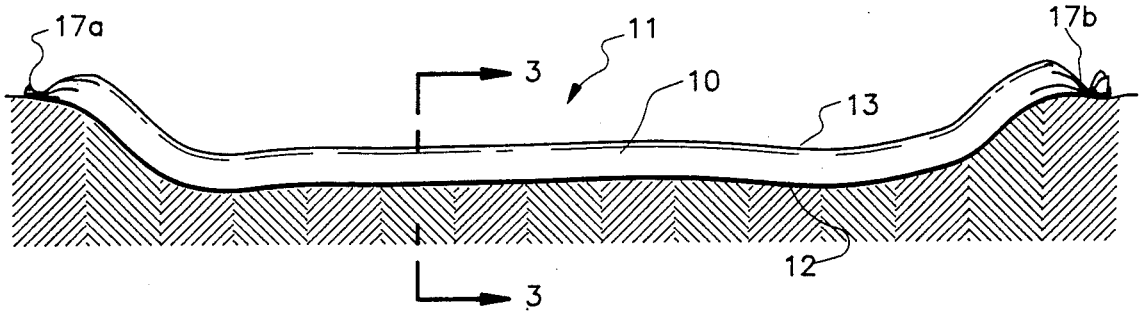
FIG. 1 is a frontal elevation view of a dam formed from water structure sections connected end-to-end across a flow channel.
Figure 2:
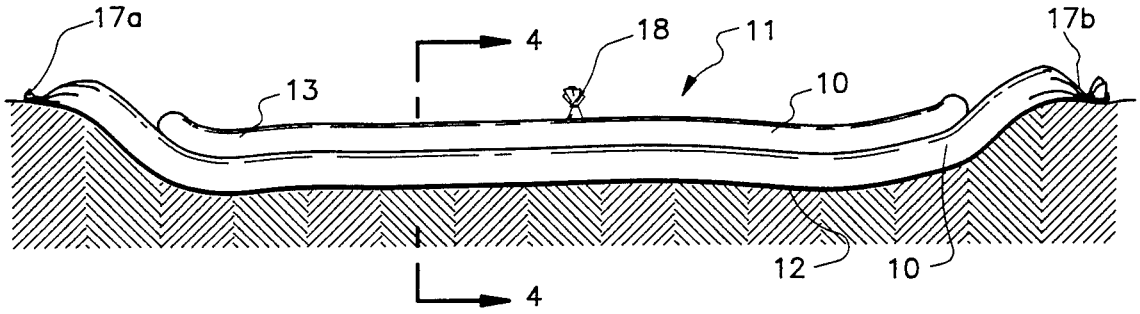
FIG. 2 is a frontal elevation view showing the flow channel of FIG. 1, as including a double layer of water filled water structure sections arranged thereacross as a dam.

FIGS. 1 and 2 show water structure sections 10 that are arranged as dams 11 across a water flow channel 12.

Figure 3:
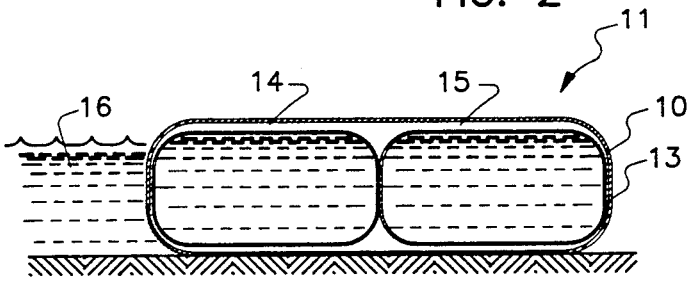
FIG. 3 is an end sectional view taken along the line 3—3 of FIG. 1.

The water structure section 10 forming the dam 11 of FIG. 1, involves a single outer sleeve 13 that is shown in cross-section in FIG. 3, as containing, in side-by-side relationship inner sleeves 14 and 15. The inner sleeves 14 and 15 are each shown as filled with a liquid that should be understood to be water. The dam 11 is shown as holding back a head of water 16. In FIG. 1, the water structure section 10 is anchored at its ends 17*a* and 17*b* to the water flow channel sides, which ends are shown as filler spouts. While a water structure consisting of an outer sleeve 13 containing only two water filled inner sleeves 14 and 15 is shown, it should be understood that more than two inner sleeves, each water filled, and stacked, as for example into a pyramid shape, may be arranged within the single outer sleeve as a water structure section 10.

Figure 4:
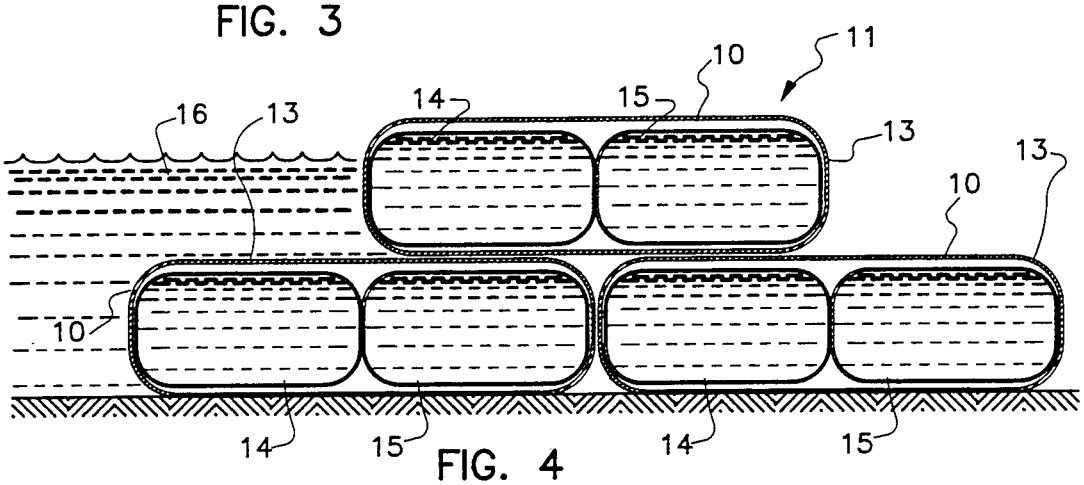
FIG. 4 is an end sectional view taken along the line 4—4 of FIG. 2.

FIG. 2 shows separate water structure sections 10 arranged in side-by-side and in layers as a two tiered dam 11. The dam 11 of FIG. 2 is shown in FIG. 4, holding back the head of water 16. A top water structure section 10 of the dam 11 of FIG. 4, is shown as having had the sleeve ends folded thereunder, the inner sleeves to be filled with water through filler spout 18.

FIG. 4 shows a side elevation sectional view of the water structure sections 10 of the dam 11 of FIG. 2, as including a pair of inner sleeves 14 and 15, respectively, that are each filled with water and are contained in side-by-side relationship, within an outer sleeve 13. Though, of course, more than two such water filled inner sleeves can be utilized contained within the outer sleeve 13, that can be single, double or even triple layered, can be arranged as a water structure section 10 within the scope of this disclosure. The liquid movement within the respective filled inner sleeves 14 and 15 tends to fill the available space, the weight of the filled inner sleeves preventing rolling or other movement even when a hydraulic force is applied thereagainst, as illustrated as water levels 16 in FIGS. 3 and 5. The water structure section 10 inner sleeves 14 and 15 may also be double or triple layered and are preferably formed by folding sleeve ends under themselves, on one or both ends, closing the sleeve before water is introduced therein. Which water introduction expands the inner sleeves 14 and 15 into a tight filling engagement with the inside wall of the outer sleeve 13.

Essentially the water structure section 10, as described above, is set out in the aforementioned earlier patent application Ser. No. 07/023,693, filed Mar. 9, 1987, of the present inventor. Which water structure section 10 can be used to form a number of liquid containing structures additional to the dams 11 of FIGS. 1 through 4. The present invention recognizes the versatility of the water structure section for creating barriers and is directed to providing sleeve coupling arrangements for joining water structure sections together into different water containing structures.

Figure 5:
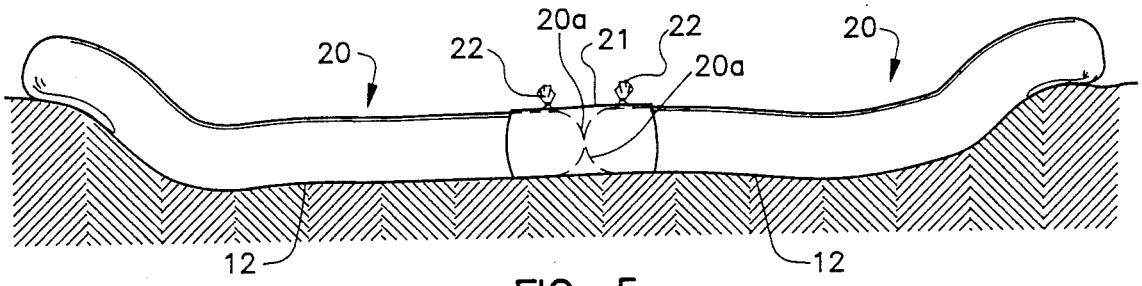
FIG. 5 is a frontal elevation view of the water structure sections joined end-to-end by a connecting sleeve arrangement of the present invention, the structure arranged across a flow channel.
Figure 6:
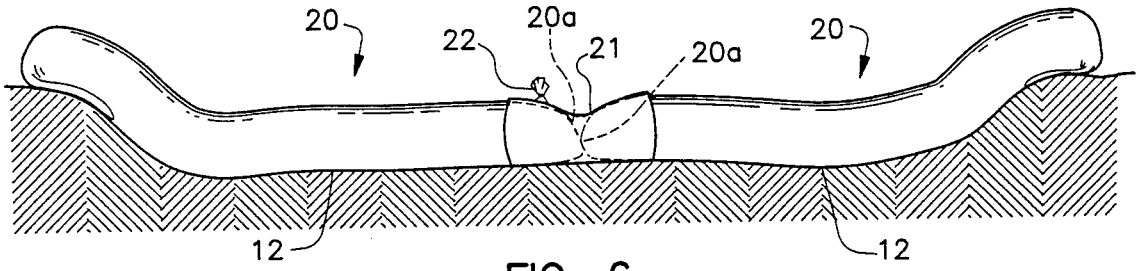
FIG. 6 is a view like that of FIG. 5, except that the connecting sleeve arrangement that joins the ends of the water structure sections is shown to be filled to a lesser height than the adjacent water structure sections leaving a center flow channel thereacross.

FIGS. 5 and 6, show a first embodiment of a connecting sleeve arrangement 21 shown joining water structure sections 20 in end-to-end relationship. FIG. 5 shows two water structure sections 20 arranged across the same flow channel 12, that was illustrated in FIGS. 1 and 2. Which water structure sections 20 are preferably like those shown in FIGS. 3 and 4. It should, however, be understood that the water structure sections 20 may further include, in addition to the side-by-side arrangement of filled inner sleeves 14 and 15, additional filled sleeves stacked within the single outer sleeve 13. For purposes of this discussion, however, the water structure sections are shown as a pair of water filled inner sleeves having closed ends and contained within and essentially filling outer sleeve 13. In practice, a sleeve or tube manufactured from a flexible polyethylene plastic material, manufactured by Armin Plastics, having a range of wall thickness of four (4) to ten (10) millimeters, of appropriate diameter has been utilized for forming the inner and outer sleeves, and the connecting sleeve and plug of the invention as described herein below, which tube or sleeve may be doubled or tripled, one tube or sleeve fitted within the other, effectively doubling or tripling wall thickness, within the scope of this disclosure.

FIG. 5 shows a dam formed of water structure sections 20 that are joined end-to-end utilizing connecting sleeve 21. The water structure section ends 20*a*, are shown in broken lines, abutting against a plug arranged within which connecting sleeve. Also, shown are filler spouts 22 that extend through the sleeve 21 for filling the inner sleeves of water structures 20. While not shown in FIGS. 5 and 6, it should be understood, that the connecting sleeve 21 preferably includes one or more water filled plugs, as illustrated in FIGS. 7 through 12, that are filled through filler spouts, as set out hereinbelow.

FIG. 6 shows the dam arrangement of FIG. 5 except that the connecting sleeve 21 is shown as having been underfilled leaving a depression at 21*a* for acting as a spillway, or the like, allowing a water flow thereover.

Figure 7:
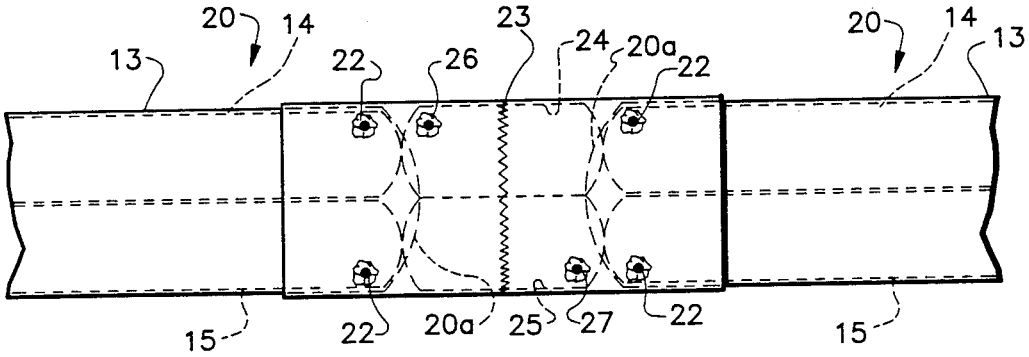
FIG. 7 is a top plan view of a section portion of the dam of FIG. 5, with the connecting sleeve shown as including a central lateral scoring therearound for functioning as a breakaway collar and includes, as shown, in broken lines, a pair of internal plugs abutting against ends of water filled inner sleeves of the water structure sections.
Figure 8:
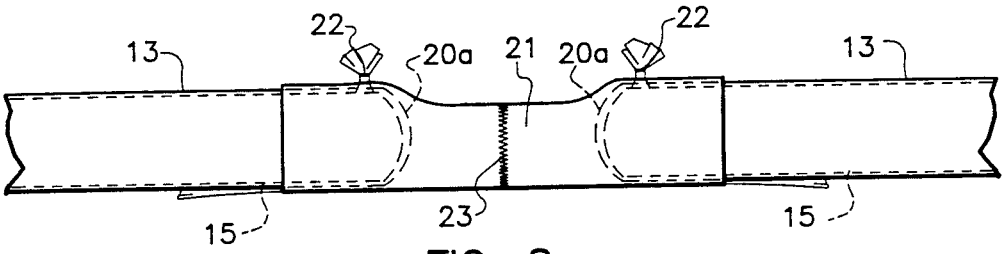
FIG. 8 is a side elevation view of the connecting sleeve of FIG. 7, showing the water structure sections inner sleeves formed by folding the ends thereof under each inner sleeve, with the connecting sleeve shown as being stretched, illustrating the water structure sections as having spread apart due to a hydraulic force applied thereto.

FIGS. 7 and 8 show an enlarged sectional view of the water structure sections 20 coupled at their ends 20*a* by connecting sleeve 21. It should be understood that connecting sleeve 21 is preferably a sleeve formed of a material like that of the outer sleeve 13 of the water structure sections, and also may be double or triple layered. The water structure section ends each contact ends of a pair of water filled plugs 24 and 25 that are contained within the connecting sleeve 21. Water structure sections 20 of this embodiment are preferably like the water structure section 10 shown in FIG. 3, each consisting of side-by-side inner sleeves 14 and 15 contained within an outer sleeve 13, which inner sleeves 14 and 15 include filler spouts 22 that, as shown in FIGS. 5 through 8, extend through the sleeve 21 for filling with water. Also, filler spouts 26 and 27 are shown fitted through the connecting sleeve 21 for filling plugs 24 and 25 with water. It should be obvious, that the filler spouts 22 can be located along the inner sleeves or at the opposite inner sleeve ends within the scope of this disclosure.

The connecting sleeve 21, is shown as having been laterally scored at 23, this scoring indicates that the sleeve has been weakened thereat to separate when a hydraulic pressure is applied thereto of sufficient force to damage the water structure sections 20. Such hydraulic force would break or tear the connecting sleeve 21, releasing the plug or plugs therefrom opening the water containing structure. Such splitting would be in lieu of damage to the water structure sections. Accordingly, the connecting sleeve 21, additional to functioning as a coupling, acts as a safety release arrangement should a potentially damaging hydraulic force be applied thereto.

Figure 9:
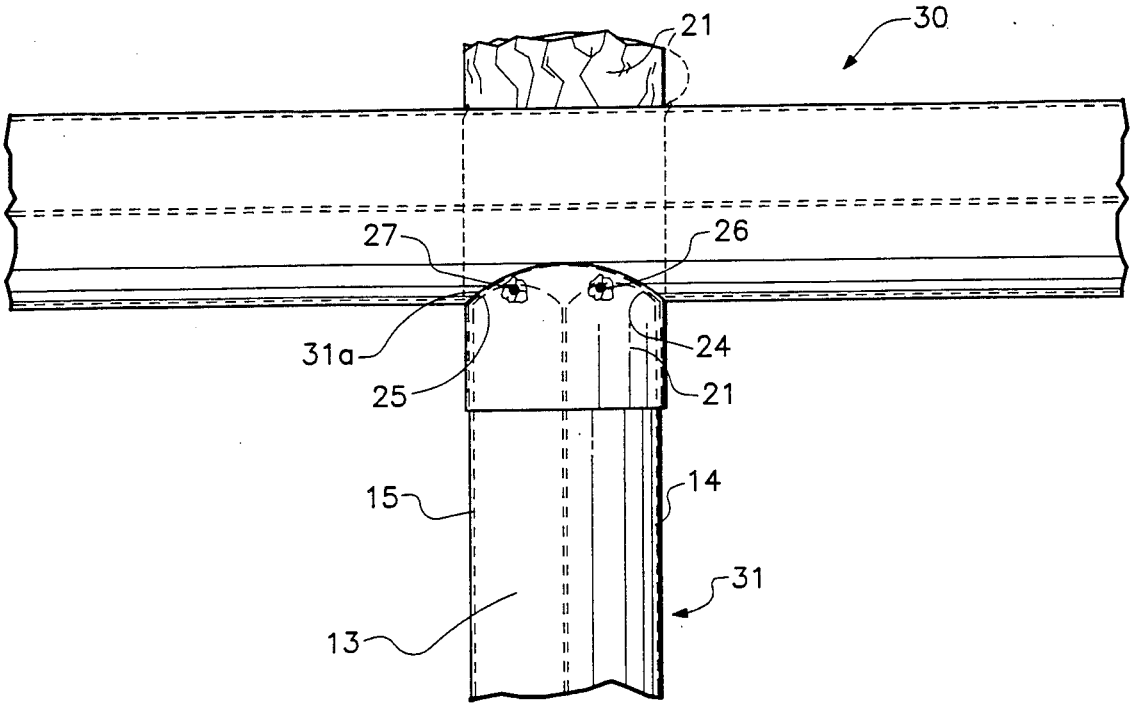
FIG. 9 is a top plan view of the connecting sleeve arrangement of FIGS. 5 through 8, showing one sleeve end as having received the end of an abutting water structure section fitted therein, the connecting sleeve arrangement shown as including two water filled plugs that have been filled through filler spouts, another water structure section shown resting on the connecting sleeve other end, the respective water structure sections forming right angles to one another.
Figure 10:
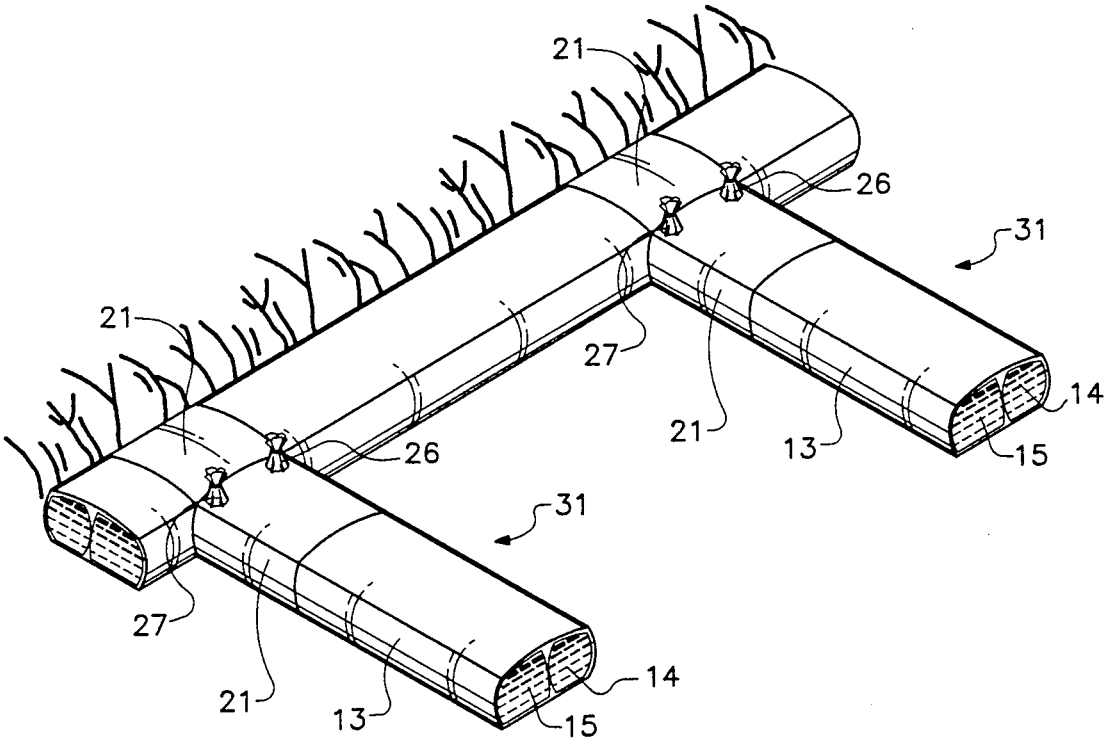
FIG. 10 is a view of two abutting water structure sections of FIG. 9, arranged as parallel individual water barriers with a level of water shown held therebetween as for separating a flooded area for de-watering.

FIGS. 9 and 10 show another application of water structure sections and connecting sleeve 21 of the present invention. Shown in FIG. 9, a water structure section 31 is connected at its end 31*a* into abutting engagement, with another water structure section 30. To provide this interconnection, one end of the connecting sleeve 21, prior to filling, receives the water structure section end 31*a* therein, with the other connecting sleeve end arranged beneath the water structure section 30. So arranged, on filling of the respective water structures 30 and 31 and connecting sleeve plugs, the connecting sleeve 21 will be locked in place under water structure section 30. The water structure section 31 end 31*a* is thereby maintained in abutting relationship to the side of water structure section 30. Shown in FIGS. 9 and 10, a right angle is formed between the respective water structure sections 30 and 31, though it should be understood, the angle of intersection could be other than a right angle within the scope of this disclosure.

Similar to the water structure section connection, as described hereinabove with respect to FIGS. 7 and 8, the connecting sleeve 21 fitted to the end of water structure section 31, includes the described individual sleeves 14 and 15 that are filled through the filler spouts 22, that are then tied off or otherwise secured to retain water. Should a hydraulic force be applied against the water structure sections 30 or 31, as could damage one or both, the connecting sleeve 21 is preferably scored as described, or otherwise arranged to shear before damage occurs to the water structure sections FIG. 10 shows an example of a configuration of a water structure section 30, with spaced apart parallel water structure sections 31 intersecting the sides thereof. This configuration is useful for isolating a water filled area, holding back water on either side thereof for dewatering, or the like.

While the pair of plugs 24 and 25 are preferably included within connecting sleeve 21, as set out above, the connecting sleeve could consist in some applications, of the open sleeve only with the ends of the individual water structure sections expanding therein against one another. However, to provide a dam structure that exhibits essentially a uniform water retaining capability thereacross, with individual water structure sections joined in end-to-end relationship, it is required that a plug of at least one water filled closed sleeve or bag be included within the connecting sleeve 21.

Figure 11:
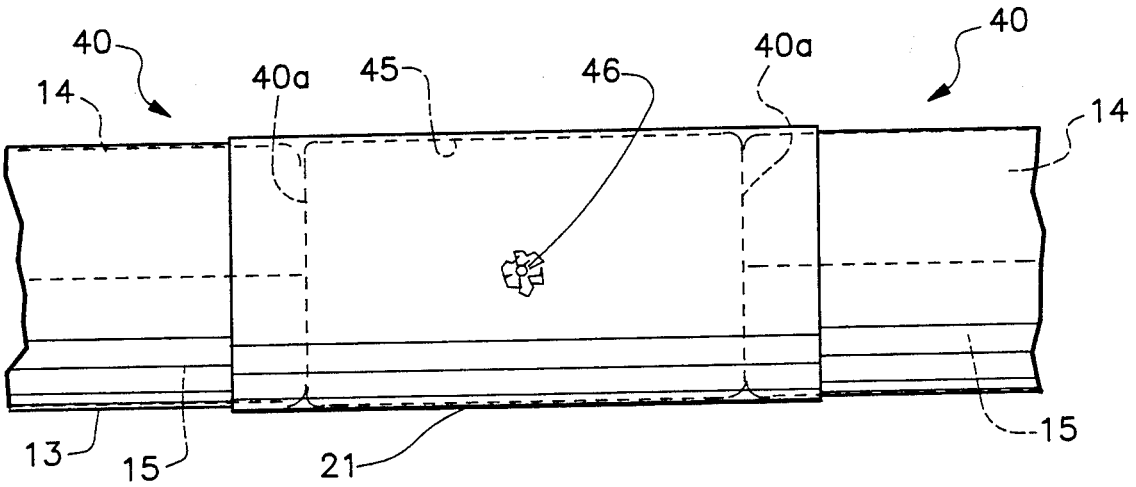
FIG. 11 shows a top plan view of the connecting sleeve arrangement coupling ends of water structure sections, which connecting sleeve, in this embodiment, includes as a plug, a single closed sleeve or bag that is water filled to butt against the ends of the filled water structure sections inner sleeves, and includes a center filler spout for passing water into that plug.
Figure 12:
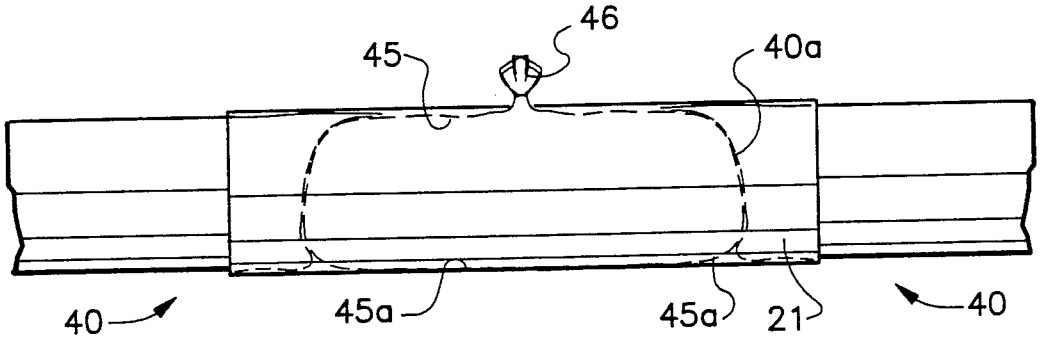
FIG. 12 shows a side elevation view of the connecting sleeve arrangement of FIG. 11.

Hereinabove, the connecting sleeve 21 is shown as including a pair of plugs 24 and 25 each filled through filler spouts 26 and 27, respectively. FIGS. 11 and 12 show another plug arrangement. FIG. 11 shows two water structure sections 40, each having ends 40*a*, that are connected by connecting sleeve 21. Which connecting sleeve 21, includes, as a plug, a single closed compartment 45 that is filled with water through a filler spout 46. With the water structure section ends 40*a* fitted within the connecting sleeve 21, both of the water structure section internal sleeves 14 and 15, as shown in FIGS. 11 and 12, can be filled through the respective filler spouts 22, with the connecting sleeve 21 plug 45 filled through filler spout 46. All of which filler spouts are shown as extended through the connecting sleeve 21, illustrated best in FIG. 11. In practice, to form the plug 45 the ends 45*a* of an open sleeve can be folded thereunder, forming a closed compartment, as shown in FIG. 12. With the arrangement of the plug ends 45*a*, respectively folded under the sleeve body, and by then filling that sleeve with water, through the filler spout 46, the weight of that water will seal off the sleeve ends 45*a* forming the plug 45.

The arrangement of the present invention is, as set out in the above described, in a connecting sleeve and plug or plugs, for connecting water structure sections to form water containing structure. As described, the connecting sleeve 21 open sleeve can be centrally scored or otherwise weakened, as described to split on application of hydraulic force of sufficient magnitude as could damage the water structure sections.

Hereinabove been set out preferred configurations of water structure sections 10 and connecting sleeves 21 for joining the described water structure sections together. To form the water structure sections, an open tube or sleeve that is to become the outer sleeve 13, is rolled out and receives the pair of inner sleeves 14 and 15 all of which may be double or triple layered for strength, as required The inner sleeves 14 and 15 are initially opened therethrough and their ends are either closed by folding them underneath the sleeve, prior to water being introduced therein, or one or both of the sleeve ends are bunched together into filler spouts. Accordingly, the water structure sections can be conveniently formed in the field by selecting tubes or sleeves of appropriate diameter to serve as the respective outer sleeve 13 and inner sleeves 14 and 15 and forming the inner sleeves into the closed sleeves 14 and 15. Thereafter, the inner sleeves are filled with water and expand into close fitting engagement with the inside of which outer sleeve 13. Which filling can be through a bunched sleeve end or through a separately installed filler spout like that shown at 22 in FIGS. 7 and 8. In the laying out for end-to-end coupling of the water structure sections, the water structure section ends are individually fitted into ends of the connecting sleeves 21. Which connecting sleeves can be formed of the same material as are the water structure sections inner and outer sleeves 14, 15 and 13, respectively. Plugs are preferably arranged in the connecting sleeves to separate the water structure end as by folding ends of an open sleeve into a bag for filling with water when the water structure sections inner sleeves are filled. The connecting sleeve 21 as described, either includes a double sleeve 24 and 25, as the plug or is a single sleeve plug 45. The water structure section inner sleeves and the connecting sleeve plug, when filled with water, both expand against the inner wall of the outer sleeve 13 and connecting sleeve 21, respectively and against one another, providing a continuous water filled barrier.

Although preferred embodiments of the invention have been shown and described herein, it should be understood that the present disclosure is made by way of example only and that variations are possible within the scope of this disclosure without departing from the subject matter coming within the scope of the following claims and reasonable equivalency thereof, which claims I regard as my invention.

I claim:

1. A water structure coupling arrangement for joining water structure sections in end-to-end or intersecting relationship where each water structure section consists of at least a pair of water filled closed inner sleeves contained within an outer sleeve, comprising a connecting sleeve that is an open cylindrical sleeve of a diameter to receive an end of a water structure section fitted therein formed of a strong flexible material; a plug means arranged within said connecting sleeve for filling with water; and filler spout means for filling said plug means with water.

2. A water structure coupling arrangement as recited in claim 1, wherein the plug means is a single flexible closed structure arranged to fit within the open cylindrical sleeve when empty and to expand, when filled with water, to the cross-sectional area of said open cylindrical sleeve; and the filler spout means extends through said open cylindrical sleeve.

3. A water structure coupling arrangement as recited in claim 2, wherein the plug means is formed by folding the ends of an open flexible sleeve under itself, and fitting it within the open cylindrical sleeve.

4. A water structure coupling arrangement as recited in claim 1, wherein the plug means consists of two like sleeves whose ends are closed each said sleeve for fitting alongside the other in the open cylindrical sleeve to expand therein against the interior wall of said open cylindrical sleeve, when filled with water through the filler spout means.

5. A water structure coupling arrangement as recited in claim 4, wherein the filler spout means for each plug means sleeve is an end of each said sleeve that is bunched and fitted through the open cylindrical sleeve.

6. A water structure coupling arrangement as recited in claim 5, wherein the plug sleeves are closed by folding the sleeves ends thereof under themselves.

7. A water structure coupling arrangement as recited in claim 1, wherein the connecting sleeve is weakened at its circumference at said connecting sleeve center.

8. A water structure coupling arrangement as recited in claim 1, wherein the connecting sleeve and plug means are each cylinders or tubes formed from a flexible plastic material.

9. A water structure coupling arrangement as recited in claim 8, wherein the connecting sleeve and plug means are each formed of a flexible polyethylene plastic material known as having a wall thickness of from four (4) to ten (10) millimeters.

10. A method for forming a water containing structure out of water structure sections that each include a plurality of water filled closed inner flexible sleeves that are contained within an outer flexible sleeve comprising the steps of, fitting an end of a first empty water structure section into one of two opposite ends of an open flexible connecting sleeve that contains, a center plug consisting of an empty closed flexible bag such that the water structure end butts against that closed flexible bag end, anchoring the opposite end of said open flexible connecting sleeve to the ground; and filling with water through filler spouts the respective water structure section inner flexible sleeves and the flexible bag that expand against each other and against the water structure section outer flexible sleeve and the open flexible connecting sleeve.

11. A method as recited in claim 10 wherein the plug is formed from a pair of closed flexible bags that are each filled with water through a filler spout that extends out from the open flexible connecting sleeve.

12. A method as recited in claim 11, wherein the ends of a pair of water structure sections are installed in the opposite ends of the open flexible connecting sleeve and the respective, closed inner flexible sleeves and open flexible connecting sleeve plug are filled with water thereby anchoring to ground the water structure sections and open flexible connecting sleeve end-to-end forming a water containing barrier.

13. A method as recited in claim 12, wherein the open flexible connecting sleeve plug is filled with water to a lesser height than the height of the adjacent water filled water structure sections functioning as a spillway.

14. A method as recited in claim 10, wherein the opposite open flexible connecting sleeve end is anchored to ground by laying a second empty water structure section thereover that is angled to the first water structure section and filling the respective first and second water structure sections and open flexible connecting sleeve plug with water.

15. A method as recited in claim 14, wherein the intersection of the first and second water structure sections is approximately a right angle.

16. A method as recited in claim 14, wherein a plurality of water structure sections are each arranged as second essentially parallel water structure sections to intersect the first water structure sections to form a water barrier separating one ground area from another when water filled.

17. A method as recited in claim 10, wherein the open flexible connecting sleeve is scored or otherwise weakened at its center circumference.

* * * * *